US005887213A

United States Patent [19]

Welp

[11] Patent Number: 5,887,213

[45] Date of Patent: Mar. 23, 1999

[54] PACKAGING FOR DENTAL X-RAY FILM AND DEVICE FOR DEVELOPING SAID FILM

[76] Inventor: Ulrich Welp, Römerstrasse 26, D-61231 Bad Nauheim, Germany

[21] Appl. No.: 860,168

[22] PCT Filed: Dec. 19, 1995

[86] PCT No.: PCT/DE95/01818

§ 371 Date: Sep. 19, 1997

§ 102(e) Date: Sep. 19, 1997

[87] PCT Pub. No.: WO96/20428

PCT Pub. Date: Jul. 4, 1996

[30] Foreign Application Priority Data

Dec. 23, 1994 [DE] Germany ..... 446247.6

[51] Int. Cl.[6] ..... G03D 17/00

[52] U.S. Cl. ..... 396/594; 396/602

[58] Field of Search ..... 396/613, 617, 396/630, 594, 596, 598, 602; 378/169

[56] References Cited

U.S. PATENT DOCUMENTS

| | | | |
|---|---|---|---|
| 3,060,860 | 10/1962 | Schmidt | 296/596 |
| 3,580,159 | 5/1971 | Buck | 396/651 |
| 3,727,533 | 4/1973 | Perl | 396/598 |
| 3,737,363 | 6/1973 | Schmidt | 396/645 |
| 4,032,943 | 6/1977 | Zwettler | 396/622 |
| 4,162,841 | 7/1979 | Dragons | 396/594 |
| 5,170,423 | 12/1992 | Yurosko | 378/168 |

FOREIGN PATENT DOCUMENTS

| | | |
|---|---|---|
| 0 363 092 | 4/1990 | European Pat. Off. . |
| 2 604 265 | 3/1988 | France . |
| 11 22 371 | 1/1962 | Germany . |
| 18 56 383 | 6/1962 | Germany . |
| 18 73 444 | 4/1963 | Germany . |
| 12 26 881 | 10/1966 | Germany . |
| 15 97 338 B2 | 4/1975 | Germany . |
| 75 35 699 | 11/1975 | Germany . |
| 27 43 808 A1 | 7/1978 | Germany . |
| 38 21 586 A1 | 1/1990 | Germany . |
| 90 02 729 U1 | 10/1990 | Germany . |
| 351 495 | 2/1961 | Switzerland . |
| WO 92/14293 | 8/1992 | WIPO . |

*Primary Examiner*—D. Rutledge
*Attorney, Agent, or Firm*—Evenson, McKeown, Edwards & Lenahan P.L.L.C.

[57] ABSTRACT

An apparatus for developing a dental x-ray film which is packaged in a light-proof envelope having two covering surfaces, in which a tear strip is formed on the covering surfaces at an edge common to the package and the covering surfaces are joined to one another so as to be easily pulled apart at their two edges running parallel to the edge with the tear strips, the apparatus having a developing tank with a developing frame underneath an entry slot in which the dental x-ray film is to be inserted. Above the entry slot leading into the developing tank and in line with the latter, the developing apparatus has an insertion shaft for the package with the dental x-ray film, which is open at the insertion end which lies across the plane of the direction of insertion of the dental x-ray film into the developing tank and at right angles to the top of the developing tank, and into which slots for receiving the tear strips of the package lead from opposite sides, these two slots being at the same time open at the insertion end.

8 Claims, 3 Drawing Sheets

PACKAGING FOR DENTAL X-RAY FILM AND DEVICE FOR DEVELOPING SAID FILM

BACKGROUND OF THE INVENTION

This invention relates to an apparatus for developing a dental x-ray film which is packaged in a light-proof envelope. More particularly, this invention relates to an apparatus for developing a dental x-ray film which is packaged in a light-proof envelope having two covering surfaces, in which a tear strip is formed on the covering surfaces at an edge common to the package and the covering surfaces are joined to one another so as to be easily pulled apart at their two edges running parallel to the edge with the tear strips, the apparatus having a developing tank with a developing frame underneath an entry slot in which the dental x-ray film is to be inserted.

The commonly used dental x-ray films have long been contained in a light-proof and saliva-proof pocket-like package made of plastic together with a lead foil, a separator card and an enveloping black paper. The separator card is arranged between the lead film and the dental x-ray film so as to protect the dental x-ray film from contact with the lead foil. Otherwise the latter would produce spots on the dental x-ray film. The black paper protects against exposure to light.

When the exposed dental x-ray film is to be developed, it must first be removed from the package in a darkened room. Removal from the package of the small 30×40 mm dental x-ray film and smaller children's 22×30 mm dental x-ray film presents difficulties, for the packages are complex and of different design and not easy to open because they have to guard the film against exposure to light and against the moisture of the mouth. Furthermore, when opening the package care must be taken to free the dental x-ray film from the lead foil, the separating card and the black paper contained loose in the package before developing. Automatic removal of the dental x-ray film from the package in the case of the known packages is not possible on account of their complicated and complex configuration.

The known packages, however, not only have the disadvantage that they can be handled only with difficulty. They are also less than desirable for environmental reasons and the safeguarding of resources. Since a lead foil is present in each package, such lead foil becomes wasted upon the opening of the dental x-ray film. For reasons of cost, therefore, the lead foil is made relatively thin, but this has the disadvantage that it absorbs only 20–40% of the x-rays and therefore offers only incomplete protection against x-radiation. The outer wrapping usually consists of polyethylene and therefore, just like the lead foil, it must not be disposed of together with the separating card and the black paper. Usually, however, for reasons of convenience, the entire wrapping with the lead foil and the polyethylene is thrown into the wastepaper basket.

After the x-ray film is unwrapped, its insertion into the developing frame of the developing apparatus presents additional difficulties, because this work also must be done in the dark. Usually the dental x-ray film is clamped to a corner on the developing frame. Often, the clamping is done in the image area, so that part of the image content is lost. The developing and fixing of the dental x-ray film that follows often takes place in the known apparatus in a less than optimum manner as regards movement and temperature. Thus x-ray images of insufficient quality are often the result.

While the development of dental x-ray films is performed in many dental practices in small, darkened and sometimes poorly ventilated rooms with developing apparatus that is hard to manipulate, developing apparatus are known in microfilm technology which are compact and simple to operate, and which can operate with fixing developers. DE-B-11 46 353 is given as an example of the state of the art. This disclosure shows a developing box onto which a cassette containing the undeveloped film is placed in a light-proof manner. After the cassette is opened this film drops into a film frame and then passes into the tank. A developing apparatus of this kind, however, is not suitable for dental x-ray films, because the latter must be housed during exposure in a very shallow and, of course, low-cost package, while the films in the above-mentioned developing apparatus run from a camera into the cassette. The cassette, therefore, is not a package but a component that is to be reused again and again.

CH-A-351 495 describes a package for a dental x-ray film which is contained in a light-proof envelope which in turn is disposed within an easy-to-open external envelope.

Tear strips are described in EP-A-0 363 092 in the case of transparent envelopes for dental x-ray films.

An apparatus for developing sheet films for measuring exposure to radiation is described in DE-B-12 26 881. In the apparatus explained in this document a developing tank has a roof-shaped upper part in the peak of which is the entry slot.

SUMMARY OF THE INVENTION

This invention is addressed to the problem of creating an apparatus for the development of a dental x-ray film initially contained in the package referred to in the beginning.

This problem is solved by the invention in that, above the entry slot leading into the developing tank and in line with the latter, the developing apparatus has an insertion shaft for the package with the dental x-ray film, which is open at the insertion end which lies across the plane of the direction of insertion of the dental x-ray film into the developing tank and at right angles to the top of the developing tank, and into which slots for receiving the tear strips of the package lead from opposite sides, these two slots being at the same time open at the insertion end.

In such an apparatus the light-proof envelope can be inserted in daylight from the insertion end into the insertion shaft such that the tear strips reach out of the slots in opposite directions. Then one needs only to pull on the two tear strips thereby tearing the light-proof envelope open and the dental x-ray film will drop through the entry slot into the developing frame.

By means of this apparatus according to the invention, the setting up of a darkroom or darkened room is unnecessary. Also eliminated is the loss of time which heretofore has been involved in the transport of the packaged dental x-ray film to the darkroom and the difficult unwrapping of the dental film therein, the complicated manipulation involved in developing it, as well as the transport of the developed dental x-ray film.

The gate body is reliably light-proof when the light-proof envelope is torn open without the need for any complicated configuration of the gate body, if according to another embodiment of the invention the gate body has a door at the insertion end which covers the two slots in a light-proof manner when the insertion shaft is closed.

When it is torn open, the light-proof envelope can protrude upwardly from the insertion slot. Then less height is required for the gate body than corresponds to the length of the dental x-ray film. An especially secure blockage of the light will result, however, if according to another embodiment of the invention the insertion shaft is closed at the top of the gate body of the end remote from the developing tank.

An alternative embodiment of the apparatus for the development of a dental x-ray film initially wrapped in the aforesaid package, which has a developing tank with a developing frame underneath an entry slot, in which the dental x-ray film is to be inserted, resides in the fact that the developing apparatus has at both sides of the entry slot two driven rolls disposed parallel to one another, which are configured for binding to the tear strips of the package.

The apparatus is configured in an especially simple manner if, according to another embodiment of the invention, one of the rolls can be driven by a hand wheel and the rolls have gears or friction wheels which are engaged with one another.

The dental x-ray film can be placed together with the developing frame into a water bath after development, so that it can be handled very conveniently, if according to another embodiment of the invention the developing frame is made easily releasable under the insertion slot by means of a snap fastening.

BRIEF DESCRIPTION OF THE DRAWINGS

The invention admits of numerous embodiments. For further clarification of its basic principle, a package according to the invention and two developing apparatus according to the invention are represented in the drawing and described below, wherein.

DESCRIPTION OF THE PREFERRED EMBODIMENTS

Figure 1:
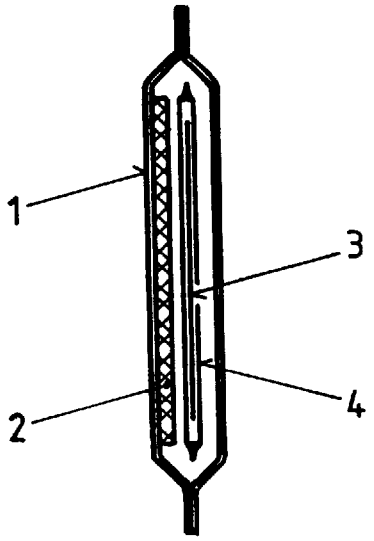
FIG. 1 is a vertical section taken through a complete package.

The package shown in FIG. 1 has an external x-ray shielding envelope 1 which consists preferably of polypropylene and must be waterproof. Bonded to an inner surface of the x-ray shielding envelope 1 is a lead foil 2, which must be thick enough to form an effective protection of the patient against x-radiation. Inside of the x-ray protective foil 1 there is a dental x-ray film 3 which is surrounded by a light-proof envelope 4. The x-ray protective foil 2 is configured at one end such that it can be opened without destroying it and reclosed, to permit the dental x-ray film 3 with the light-proof envelope to be removed from it.

Figure 2:
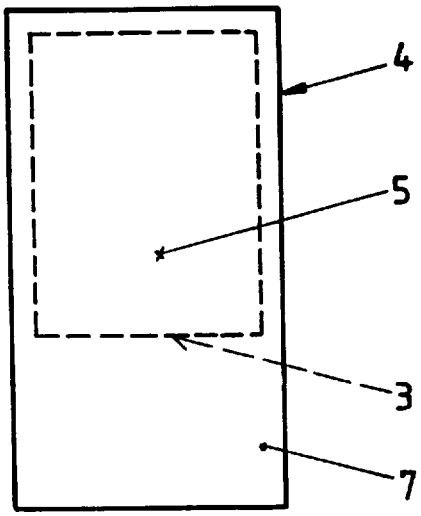
FIG. 2 is a front elevational view of a light-proof envelope of the package.
Figure 3:
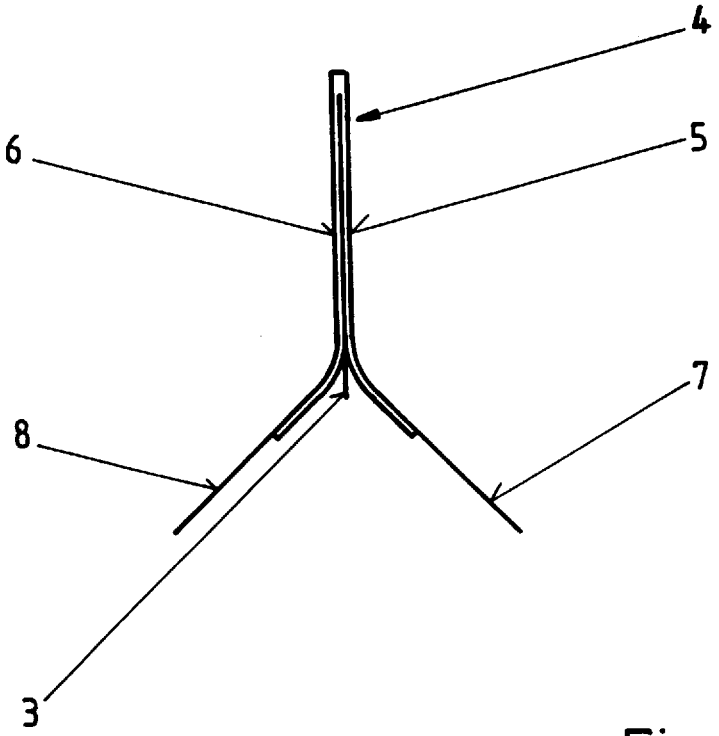
FIG. 3 is a side view of the envelope while it is being torn open.

FIG. 2 shows the light-proof envelope 4 from its broad side. Consequently a covering surface 5 is seen, which is disposed in back of the dental x-ray film 3. Seen in FIG. 2 behind the dental x-ray film 3 is an additional covering surface 6, which can be seen in FIG. 3. A tear strip 7 is formed on the covering surface 5. As shown in FIG. 3, the covering surface 6 has a corresponding tear strip 8. If the tear strips 7 and 8 are pulled apart, as it can be seen in FIG. 3, the covering surfaces 5 and 6 are torn apart, so that the dental x-ray film 3 comes free of the light-proof envelope 4 and drops downward out of it.

Figure 4:
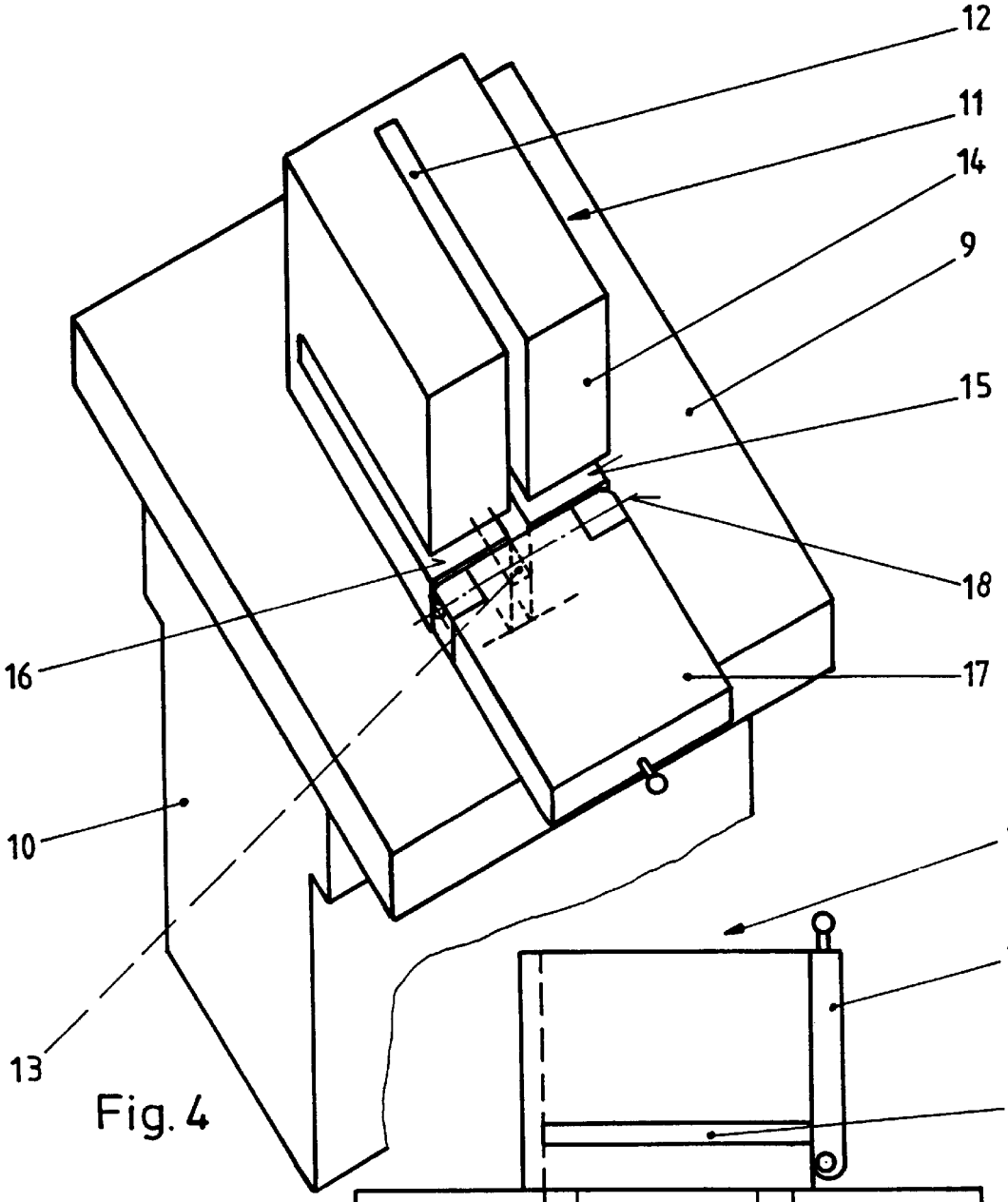
FIG. 4 is a perspective view of a cover of a developing tank according to the invention.

FIG. 4 shows in perspective a cover 9 of a developing apparatus which is set down upon a partially shown developing tank 10 and on which a light-proof gate body 11 is disposed. This light-proof gate body 11 has an insertion shaft 12 which is in line with an entry slot 13 in the cover 9. The insertion shaft 12 is open at the top but also toward an insertion side 14 of the light-proof gate body 11. This insertion side 14 is at right angles to the plane of the cover 9 and is situated on a narrow side of the entry slot 13.

From the opposite sides slots 15 and 16, lead into the insertion shaft 12. A door 17 shown open in FIG. 4 can be turned on a hinge axis 18 so as to lie in a light-proof manner against the insertion side 14 when closed.

To develop a dental x-ray film 3, the light-proof envelope 4 with the dental x-ray film is inserted from the insertion side 14 into the insertion shaft 12 such that its two tear strips 7 and 8 will come to rest in the slots 15 and 16 and protrude therefrom to the left and right as shown in FIG. 2. Then the door 17 is closed, and the two tear strips 7 and 8 are pulled apart thereby tearing open the light-proof envelope 4 and the dental x-ray film 3 can drop down through the entry slot 13 into the developing tank 10.

Figure 5:
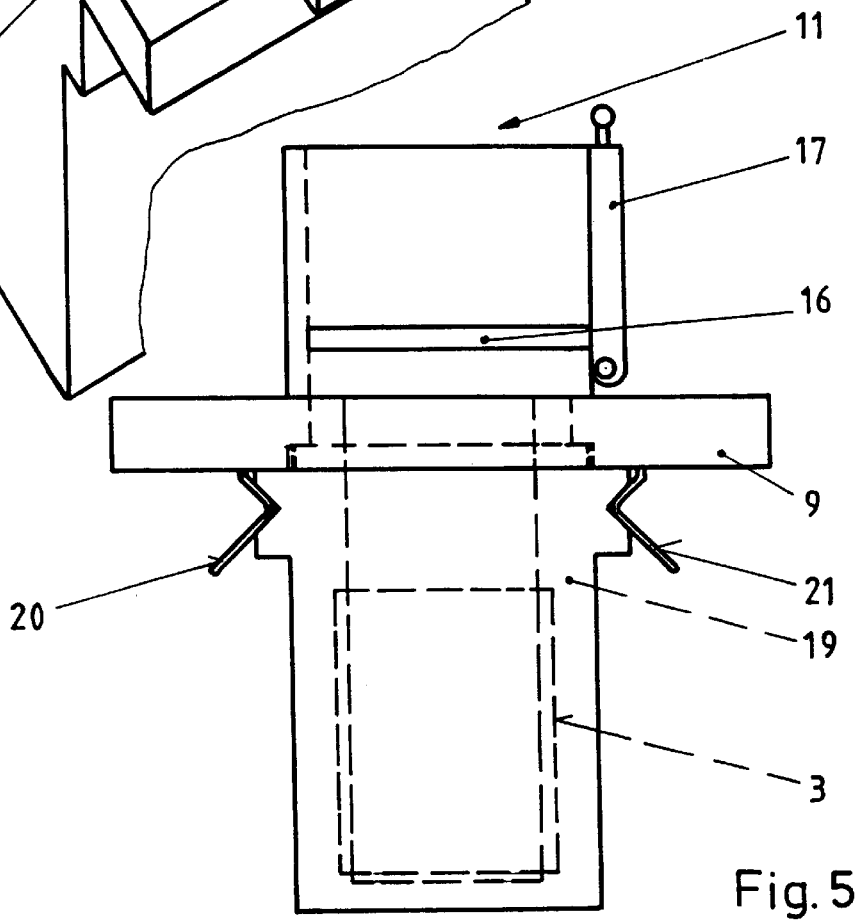
FIG. 5 is a side view of the cover with a developing frame.

FIG. 5 shows that a developing frame 19 is held at the underside of the cover 9 by a snap catch having two spring means 20–21. This developing frame 19 is of such dimensions that a dental x-ray film 3 inserted through the light-proof gate body will drop down onto the bottom end of the developing frame 19.

Figure 6:
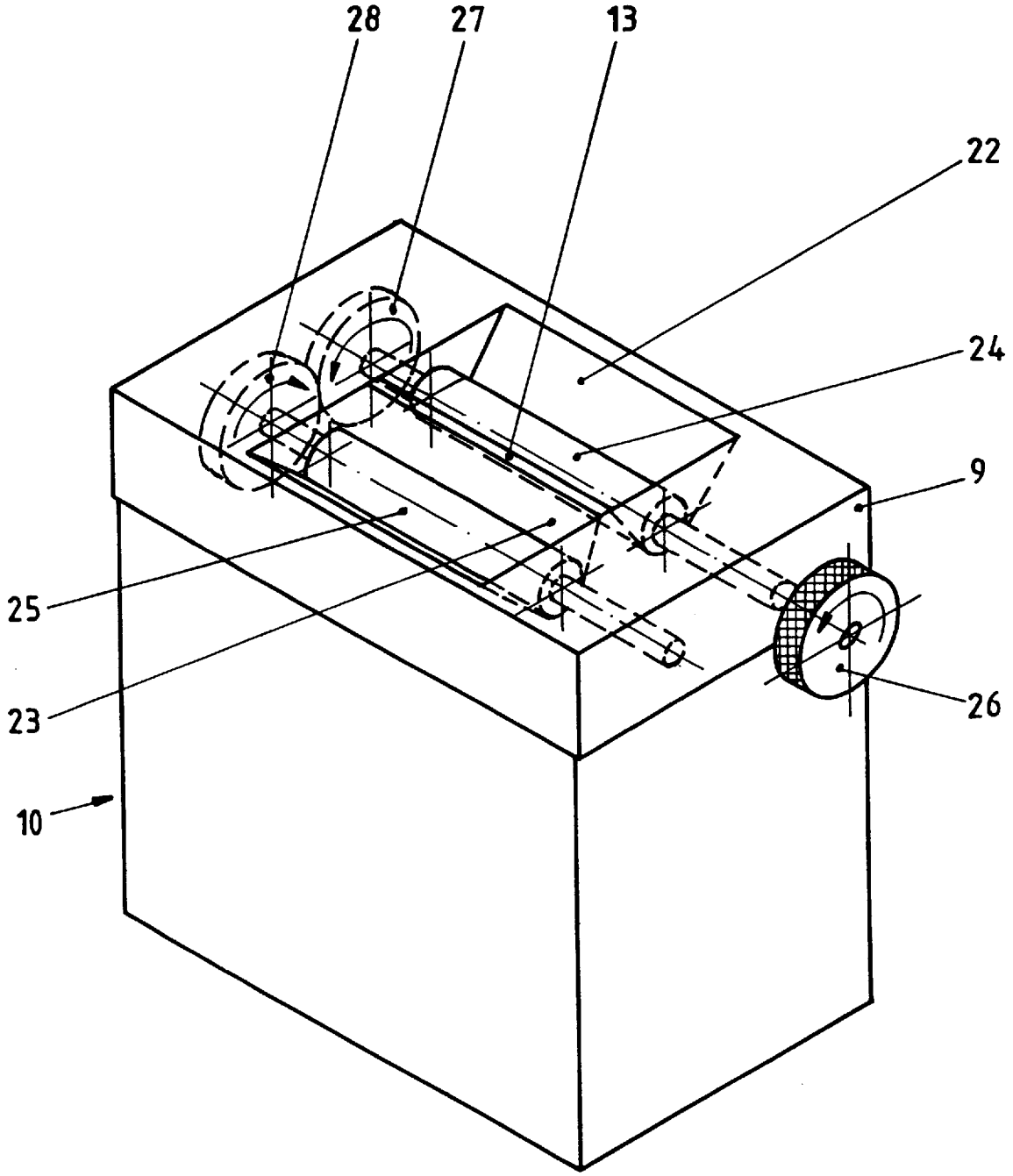
FIG. 6 is a perspective view of a second embodiment of a cover of the developing tank.

In the embodiment according to FIG. 6 the entry slot 13 is in the cover 9 between two rolls 24 and 25 disposed each in a trough 22 and 23. Roll 24 can be rotated by means of a hand wheel 26. Gears or friction wheels 27 and 28 transmit this rotary movement to the other roll 25.

If it is desired to develop a dental x-ray film 3 in the developing tank 10, the light-proof envelope 4 with the dental x-ray film 3 is placed on the entry slot 13 and the tear strips 7 and 8 are fastened to the rolls 24 and 25. Then the handwheel 26 is turned, thereby winding the tear strips 7 and 8 increasingly onto the rolls 25 and 25 and the light-proof envelope is torn open so that the dental x-ray film 3 drops into the interior of the developing tank 10. It is caught in vertical grooves in the developing frame, corresponding to the developing frame 19 in FIG. 5.

I claim:

1. Apparatus for developing a dental x-ray film which is packaged in a light-proof envelope having two cover leaves, in which a tear strip is formed on each of the cover leaves at an edge common to the package and the cover leaves are joined together for easy separation at their two edges running parallel to the edge with the tear strips, said apparatus comprising a developing tank with a developing frame underneath an entry slot in which the dental x-ray film is to be inserted, a gate body above the entry slot leading into the developing tank and in line therewith, the gate body having an insertion shaft for the package with the dental x-ray film, which is open at an insertion end lying across the plane of the direction of entry of the dental x-ray film into the developing tank and at right angles to the top of the developing tank, and into which there leads from opposite sides slots for receiving one tear strip each, these two slots being both open at the insertion side.

2. Apparatus according to claim 1, wherein the gate body has, at its insertion end, a door covering the insertion shaft and the two slots in a light-proof manner.

3. Apparatus according to claim 1, wherein the insertion shaft is closed at the end of the gate body remote from the top of the development tank.

4. Apparatus according to claim 2, wherein the insertion shaft is closed at the end of the gate body remote from the top of the development tank.

5. Apparatus for developing dental x-ray films, which is wrapped in a light-proof envelope having two cover leaves, in which tear strips are formed on the cover leaves at the edge common to the package, and the cover leaves are joined together for easy separation at their two edges running parallel to the edges bearing the tear strips, said apparatus comprising a developing tank with a developing frame underneath an entry slot in which the dental x-ray film is to be inserted, and two drivable rolls (24, 25) disposed at both ends of the entry slot parallel to one another on both sides of the entry slot, which are designed for attachment to the tear strips of the package.

6. Apparatus according to claim 5, wherein one of the rolls can be driven by a hand wheel and each of the rolls has a gear or friction wheel which are in engagement with one another.

7. Apparatus according to claim 6, wherein the developing frame is disposed underneath the entry slot for easy release by means of a catch connection.

8. Apparatus according to claim 5, wherein the developing frame is disposed underneath the entry slot for easy release by means of a catch connection.

* * * * *